United States Patent [19]

Matsuura

[11] Patent Number: 4,710,099

[45] Date of Patent: Dec. 1, 1987

[54] MULTI-STAGE TURBINE

[75] Inventor: Toshihiro Matsuura, Tokyo, Japan

[73] Assignee: Kabushiki Kaisha Toshiba, Kawasaki, Japan

[21] Appl. No.: 18,733

[22] Filed: Feb. 24, 1987

Related U.S. Application Data

[63] Continuation of Ser. No. 803,348, Dec. 2, 1985, abandoned.

[30] Foreign Application Priority Data

Nov. 30, 1984 [JP] Japan ..... 59-253265

[51] Int. Cl.[4] ..... F01D 9/04

[52] U.S. Cl. ..... 415/199.5; 415/181

[58] Field of Search ..... 415/181, 119, 191, 192, 415/199.2, 199.4, 199.5; 416/204 R, 204 A, 210 R, 210 A, 211, 236, 237, 222

[56] References Cited

U.S. PATENT DOCUMENTS

| | | | |
|---|---|---|---|
| 741,776 | 10/1903 | Dodge | 415/115 |
| 1,048,564 | 12/1912 | Metten | 416/216 |
| 1,152,218 | 8/1915 | Rearick | 416/210 A |
| 1,801,427 | 4/1931 | Holzwarth | 416/216 |
| 2,951,677 | 9/1960 | Howard | 415/199.5 |
| 4,426,191 | 1/1984 | Brodell et al. | 415/199.5 |
| 4,537,560 | 8/1985 | Emeterio et al. | 415/199.5 |

FOREIGN PATENT DOCUMENTS

| | | | |
|---|---|---|---|
| 53-92008 | 1/1978 | Japan . | |
| 53-126409 | 4/1978 | Japan . | |
| 6745 | of 1904 | United Kingdom | 415/199.5 |

OTHER PUBLICATIONS

Table I. Stator Blade Coordinates NASA, pp. 13–18.

*Primary Examiner*—Robert E. Garrett
*Assistant Examiner*—John T. Kwon
*Attorney, Agent, or Firm*—Oblon, Fisher, Spivak, McClelland, & Maier

[57] ABSTRACT

A multi-stage turbine which includes a rotor disk with grooves formed in its outer portion, a plurality of blades mounted in the grooves of the rotor disk by means of anchoring portions, a shroud mounted at the circumference of the blades and linking the blades together, a casing arranged opposite the outer circumference of the blades, and a plurality of nozzles mounted at the inner circumference of the casing and having nozzle plates arranged upstream of the blades, the turbine thus being constructed of a plurality of stages which include blades and nozzles, wherein blades of a plurality of adjacent stages are supported by the anchoring portions.

7 Claims, 11 Drawing Figures

MULTI-STAGE TURBINE

This application is a continuation of application Ser. No. 803,348, filed on Dec. 2, 1985, now abandoned.

BACKGROUND OF THE INVENTION

1. Field of the Invention:

The present invention relates to a turbine, and in particular relates to a steam turbine and a gas turbine wherein the turbine blades are mounted on a rotor disk.

2. Discussion of the Background:

FIG. 9 is a diagrammatic axial cross-sectional view showing a conventional turbine. In the turbine shown in FIG. 9, a large number of stages 4 consisting of nozzles 2 and turbine blades 3 (hereinbelow simply called "blades") are provided along the axial direction of a rotor disk 1. Turbine nozzles 2 are formed by nozzle plates 5 constituting fluid passages, a nozzle outer ring 6 onto which these nozzle plates 5 are fixed from the outer side, and a nozzle diaphragm inner ring 7 onto which nozzle plates 5 are fixed from the inner side. The nozzles 2 are supported on a casing 8 through the nozzle outer ring 6 that is fitted into a circular groove 9 provided on the inner circumference of the casing 8. As shown in FIG. 10, the blade 3 consists of an effective blade portion 10 through which the operating fluid flows, a dovetail-shaped anchoring portion 11 provided at the bottom of the effective blade portion 10, and a tenon 12 provided at the top of the effective blade portion 10. These blades 3 are mounted on the rotor disk 1 by fitting anchoring portions 11 from the circumferential direction of the rotor disk 1 into grooves 13 formed through the outer circumference of the rotor disk 1. The blades 3 are mounted with a prescribed separation in the peripheral direction around the entire circumference of the rotary disk 1 and are linked together by shrouds 14, which are mounted as shown in FIG. 9 at the outer circumference of the blades 3 by caulking tenons 12. The flow direction of the operating fluid is shown by arrow A in FIG. 9.

However, in the conventional turbine constructed in this manner, during operation of the turbine, wakeflow, including slow flow containing eddies coming from the trailing edge of nozzle plates 5 of the upstream nozzle 2, reaches the effective portions 10 of the blades. The velocity distribution of the wakeflow of these nozzle plates 5 is diagrammatically shown in FIG. 11. The non-uniform flow, including a lower-velocity portion, represented by the wakeflow causes effective portions 10 of the blades to receive an excitation pulsating force each time they pass through the pitch interval of the nozzle plates 5. This excitation frequency is expressed by the relationship equal to:

(number of nozzle plates)×(velocity of rotor rotation).

Blades 3 resonate if this excitation frequency equals any of the resonant frequencies of blades 3. If such resonance occurs, this subjects the blades 3 to high vibrational stresses, risking local damage or failure.

Conventionally, to avoid resonance, the number of nozzle plates 5 was selected such that none of the resonant frequencies of the blades 3 would coincide with the excitation frequency. However, it is difficult to accurately predict the resonant frequencies of the blades 3. Another problem was that turbine efficiency was adversely affected by the need to select the number of nozzle plates 5 such that none of the resonant frequencies of the blades 3 would coincide with the excitation frequency. Due to this restriction imposed on the number of nozzle plates 5 which can be utilized, the nozzle plates 5 were not disposed circumferentially at the optimum pitch to give the highest efficiency.

SUMMARY OF THE INVENTION

An object of the present invention is to provide a turbine wherein blade failure due to resonance can be prevented and efficiency can be improved.

In order to achieve the above object according to the present invention, there are provided: a rotor disk with grooves formed in its outer portion; a plurality of blades mounted in the grooves of the rotor disk by means of anchoring portions; a shroud mounted at the circumference of the blades and linking the blades together; a casing arranged opposite the outer circumference of the blades; and nozzles mounted at the inner circumference of the casing and having nozzle plates arranged upstream of the blades; the entire turbine being constructed of a plurality of stages consisting of blades and nozzles, and blades of a plurality of adjacent stages being supported by the anchoring portions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
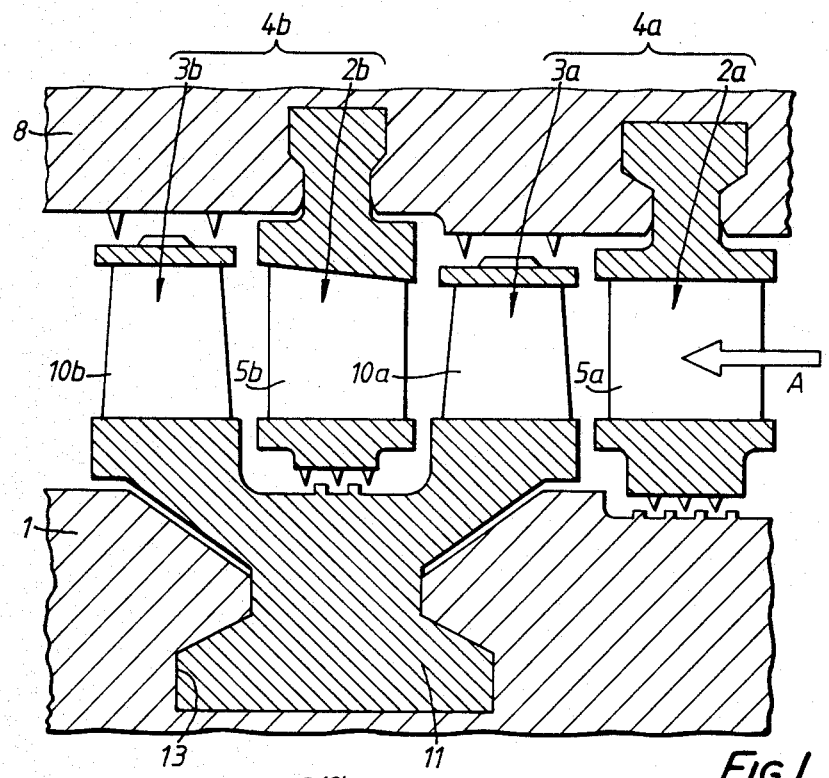
FIG. 1 is a diagrammatic axial sectional view of a first embodiment of the turbine of the present invention.

FIG. 1 is a diagrammatic axial sectional view showing a first embodiment of the turbine of the present invention. The arrow A in the drawing shows the direction in which the operating fluid flows. Two stages are shown in FIG. 1. For convenience in description, the right stage will be designated as an upstream stage 4a and the left stage designated as a downstream stage 4b.

Figure 2:
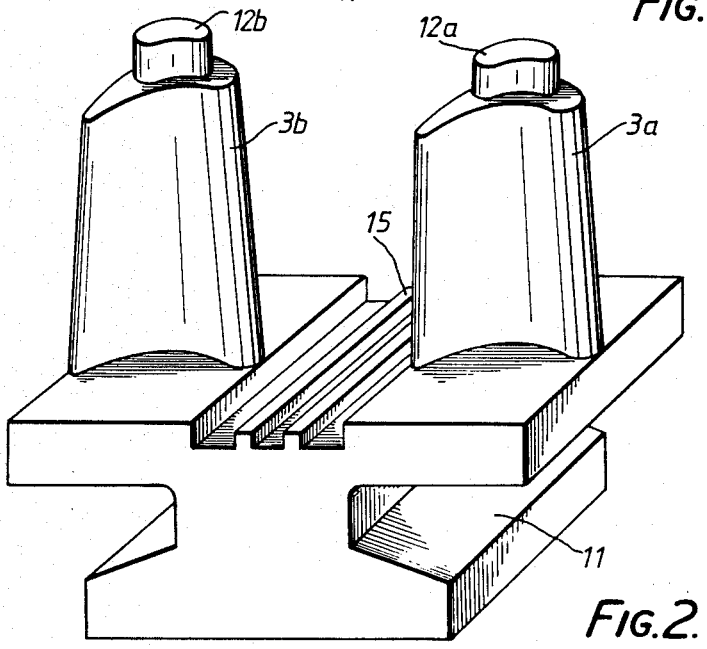
FIG. 2 is a perspective view showing a blade of the turbine shown in FIG. 1.

In the turbine constituting the first embodiment, blades 3a of the upstream stage 4a and blades 3b of the downstream stage 4b are anchored by a single common anchoring portion 11 as shown in FIG. 2. These anchoring portions 11 have a dovetailed shape, and are formed so that they can be fitted in from the circumferential direction of the rotor disk 1 into the dovetail grooves 13 provided in the circumference of the rotor disk 1. The outside circumferential face of the anchoring portion 11 is further provided, in between the stages, with a concave/convex stepped portion 15 for mounting sealing fins (not shown).

Figure 3:
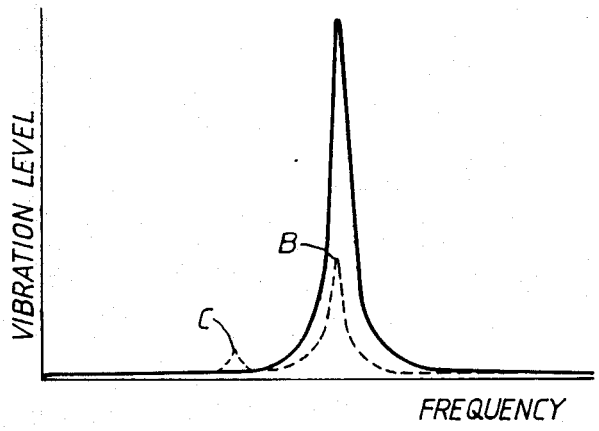
FIG. 3 is a graph showing resonance levels of a turbine according to the present invention and a conventional turbine.

Just as in the conventional turbine, in the turbine of the first embodiment, during operation, effective portion 10a of the blades of upstream stage 4a and effective portion 10b of the blades of downstream stage 4b are subjected to an excitation force acting each time they move through the pitch interval of respective nozzle plates 5a, 5b, due to the eddies-containing wakeflow coming from the trailing edges of nozzle plates 5a of upstream stage 4a and from the trailing edges of nozzle plates 5b of downstream stage 4b. Assuming that in this case a resonance is produced in the blades 3a of the upstream stage 4a *by the wakeflow behind nozzle plates 5a*, the vibration level of blades 3a will be as shown in FIG. 3. The continuous line in FIG. 3 shows the vibration level of turbine blades 3a of the conventional turbine, in which the blades 3a of the upstream stage 4a and the blades 3b of the downstream stage 4b were separate from and independent of each other. The broken line, on the other hand, shows the vibration level in the turbine of the first embodiment, in which blades 3a of the upstream stage 4a and blades 3b of the downstream stage 4b are integrally coupled by means of the anchoring portions 11. It can be seen from FIG. 3 that the resonance level B of the turbine of the first embodiment is much lower than that of the conventional turbine. The reason for this is believed to be that part of the resonance energy of blades 3a of upstream stage 4a of the first embodiment is dissipated in causing vibration of blades 3b of downstream stage 4b. The resonance level C of blades 3b of downstream stage 4b is contained in the resonance level of the turbine of the first embodiment, but its value is very small and can be neglected. With the first embodiment, even though blades 10 do resonate because of the wakeflow behind the nozzle plates 5, the level of vibration can be reduced, preventing damage to, or failure of, the blades 10.

FIG. 1 and FIG. 2 show a case in which the number of effective portions 10a and 10b of the blades of upstream stage 4a and downstream stage 4b are the same. However, the present invention is not restricted to the first embodiment, and could also be applied to cases in which the ratio of the numbers of effective portions 10a and 10b of blades are expressed by an integer ratio. However, in this case it is necessary that the ratio of blades 3a and 3b that are integrally coupled by the anchoring portions 11 should be the aforesaid integer ratio.

Figure 4:
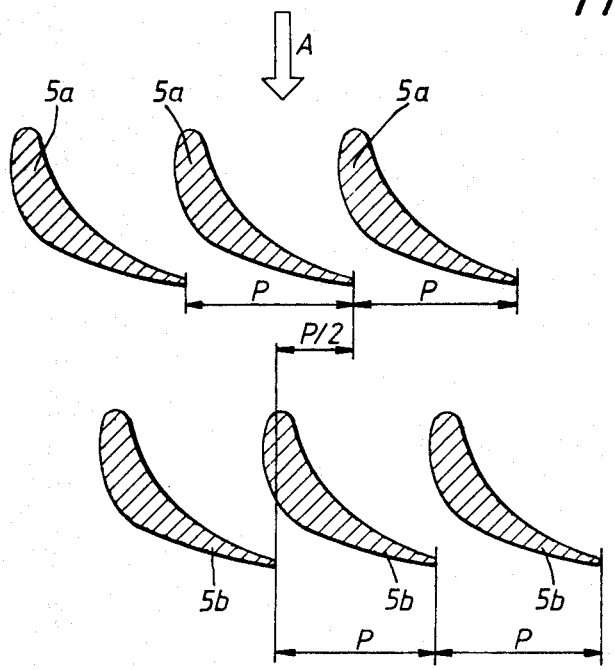
FIG. 4 is a diagram showing the arrangement of the nozzle plates of a second embodiment of the turbine of the present invention.

FIG. 4 shows a second embodiment of a turbine according to the present invention. In the turbine of the second embodiment, the numbers of nozzle plates 5a *and 5b* of the upstream stage 4a and downstream stage 4b are equal, and the locations of nozzle plates 5a and 5b in the circumferential direction are offset, as between the upstream stage 4a and downstream stage 4b, by half the pitch in the circumferential direction. Otherwise the construction is the same as in the first embodiment.

The resonant vibration level in the second embodiment can be further reduced from the level of the first embodiment. A qualitative explanation is as follows.

In general, the force $F_1$ that blades 3a of upstream stage 4a receive from the wakeflow behind nozzle plates 5a may be expressed by the following formula:

$$F_1 = a_1 \cos \omega t$$

where $a_1$ is the magnitude (half-amplitude) of the excitation force of the upstream stage, and $\omega$ represents the angular frequency of vibration.

In the same manner, the force $F_2$ that blades 3b of downstream stage 4b *receive from the wakeflow behind nozzle plates 5b* may be expressed by the following formula:

$$F_2 = a_2 \cos(\omega t + \alpha)$$

where $\alpha$ is the phase-difference between the excitation forces of the upstream and downstream stages, and $a_2$ represents the magnitude of the excitation force of the downstream stage.

The actual force $F_3$ exerted on blades 3a of upstream stage 4a is therefore expressed by the following formula:

$$\begin{aligned} F_3 &= F_1 + K \cdot F_2 \\ &= a_1 \cos \omega t + a_3 \cos(\omega t + \alpha) \\ &= \sqrt{a_1^2 + 2a_1a_3 \cos \alpha + a_3^2} \times \cos(\omega t + \beta) \end{aligned}$$

where K is a proportional constant, $a_3$ is $K \cdot a_2$, and $\beta$ represents:

$$\tan^{-1} \frac{a_1 + a_3 \cos \alpha}{a_3 \sin \alpha}$$

Thus, if the circumferential locations of the nozzle plates 5a and 5b of upstream stage 4a and downstream stage 4b are offset circumferentially by half the pitch, as in the second embodiment, the phase difference becomes approximately and the amplitude of the force $F_3$ that is applied to blades 3a is expressed by the following formula:

$$\sqrt{a_1^2 + 2a_1a_3 \cos \pi + a_3^2} = |a_1 - a_3|$$

Thus, with the second embodiment, a very considerable reduction in the resonant vibration level can be achieved, since the force that acts on blades 3a due to the wakeflow behind nozzle plates 5a of upstream stage 4a is greatly reduced by the force acting on blades 3a through blades 3b of downstream stage 4b.

Figure 5:
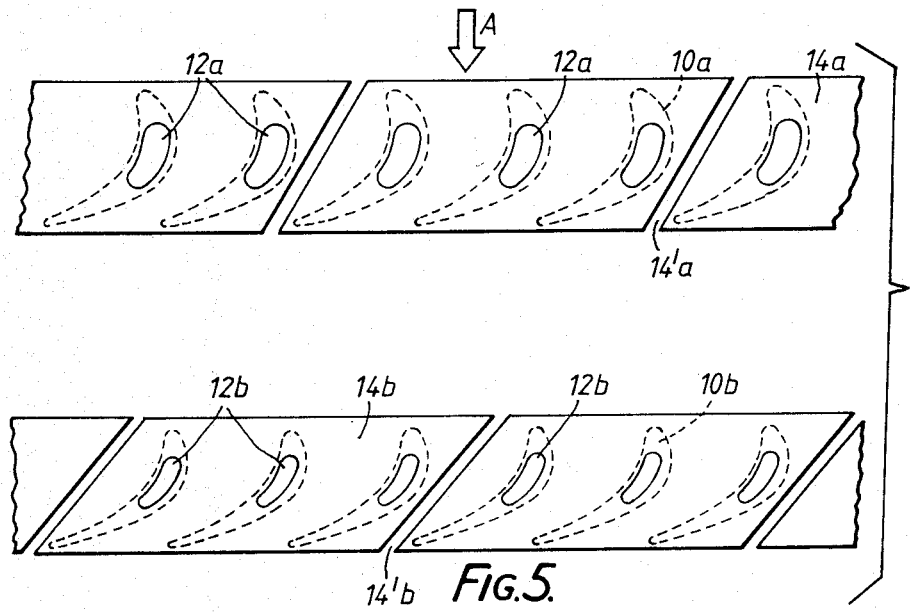
FIG. 5 is a diagram showing the shrouds of a third embodiment of the turbine of the present invention in an installed condition.

FIG. 5 shows a third embodiment of a turbine according to the present invention. A shroud 14a, 14b mounted through tenons 12a, 12b at the periphery of effective portions 10a, 10b of the blades is divided at prescribed intervals in the circumferential direction.

In the downstream stage 4b, the gaps 14'a and 14'b of these shrouds 11a and 11b are offset in the circumferential direction, so as not to be mutually aligned. The groups of blades respectively belonging to the upstream stage 4a and downstream stage 4b are therefore coupled around the entire circumference, by means of their anchoring portions 11 and the shroud 14*a*, 14*b*. Apart from further reducing the vibration level, the third embodiment has the advantage that the rigidity of blades 3*a*, 3*b*, can be much increased.

Figure 6:
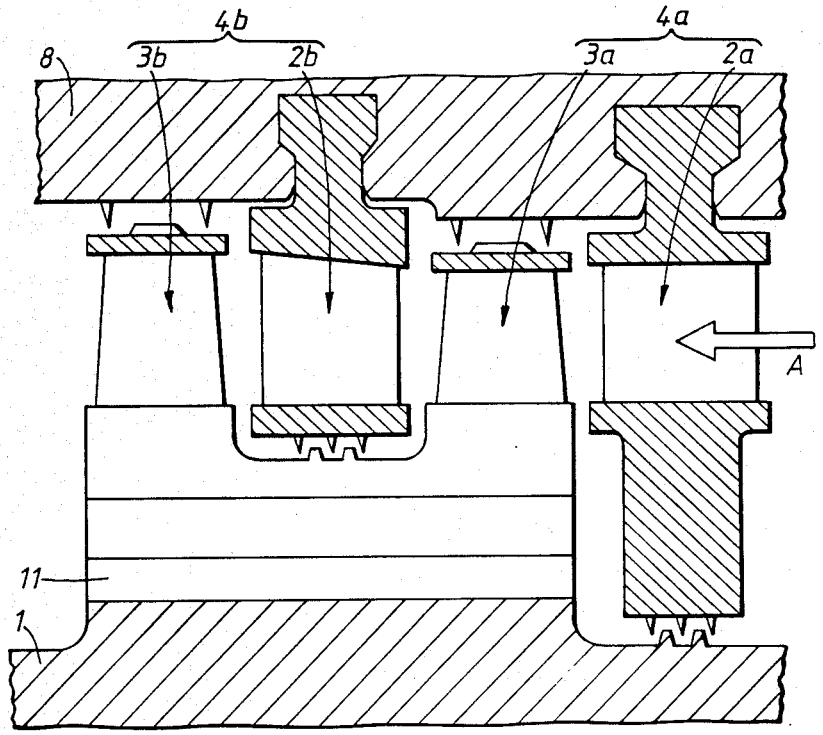
FIG. 6 is a diagrammatic axial view showing a fourth embodiment of the turbine of the present invention.
Figure 7:
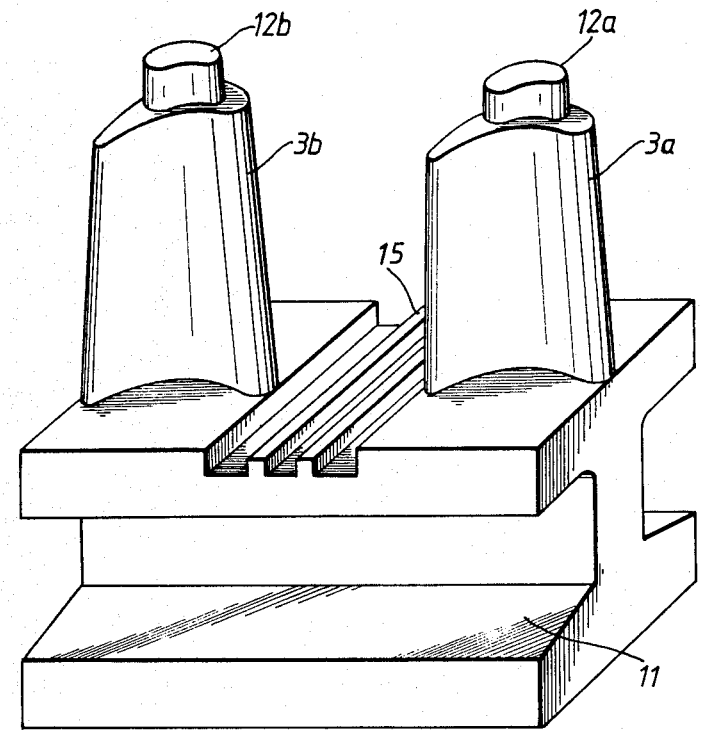
FIG. 7 is a perspective view showing blades of the turbine according to the present invention shown in FIG. 6.

FIG. 6 shows a fourth embodiment of a turbine according to the present invention. As shown in FIG. 7, anchoring portions 11 that couple blades 3*a* of upstream stage 4*a* and blades 3*b* of downstream stage 4*b* are integrally formed so as to be fitted in from the axial direction of the rotor disk 1. Otherwise the construction is the same as in the first embodiment.

The same advantages can be obtained with the fourth embodiment as with the first embodiment. The modifications of the second and third embodiments can of course also be applied to the fourth embodiment.

Figure 8:
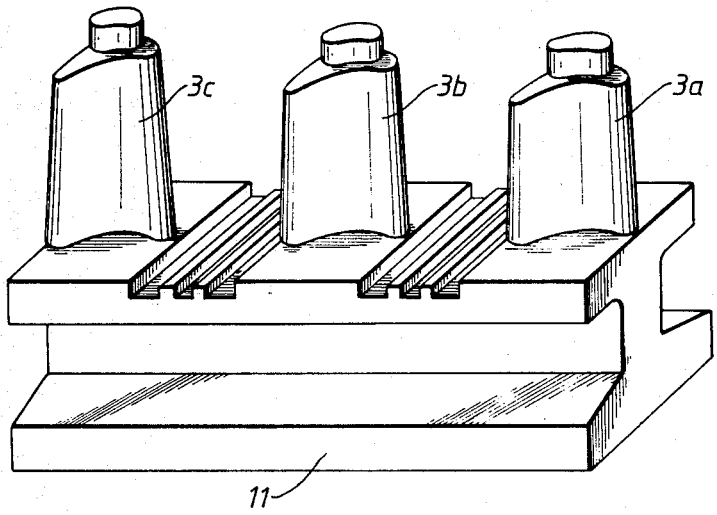
FIG. 8 is a perspective view showing blades of a fifth embodiment of the turbine of the present invention.
Figure 9:
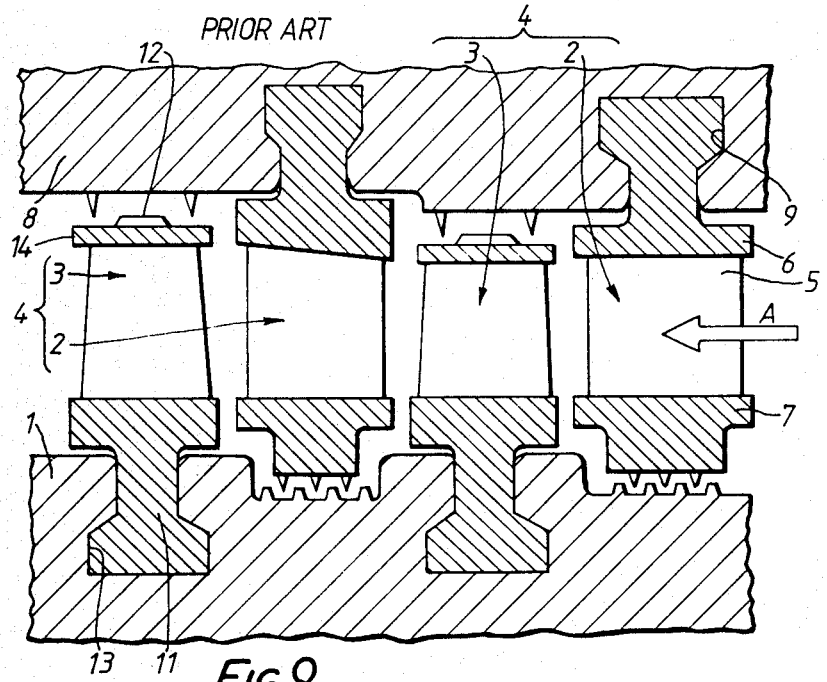
FIG. 9 is a diagrammatic axial sectional view of the conventional turbine.
Figure 10:
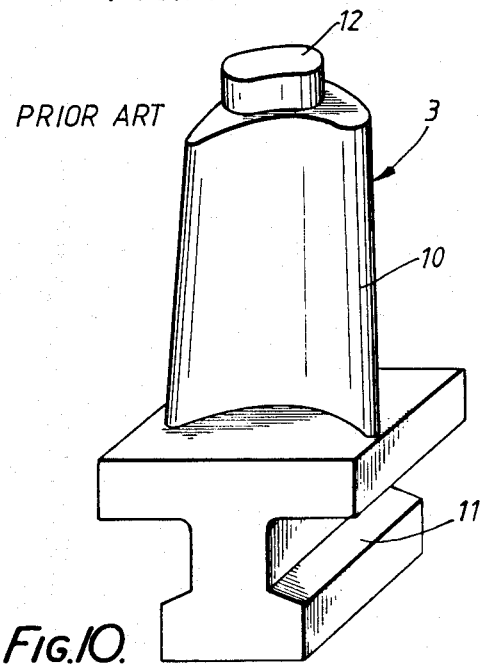
FIG. 10 is a perspective view showing a blade of the conventional turbine shown in FIG. 9.
Figure 11:
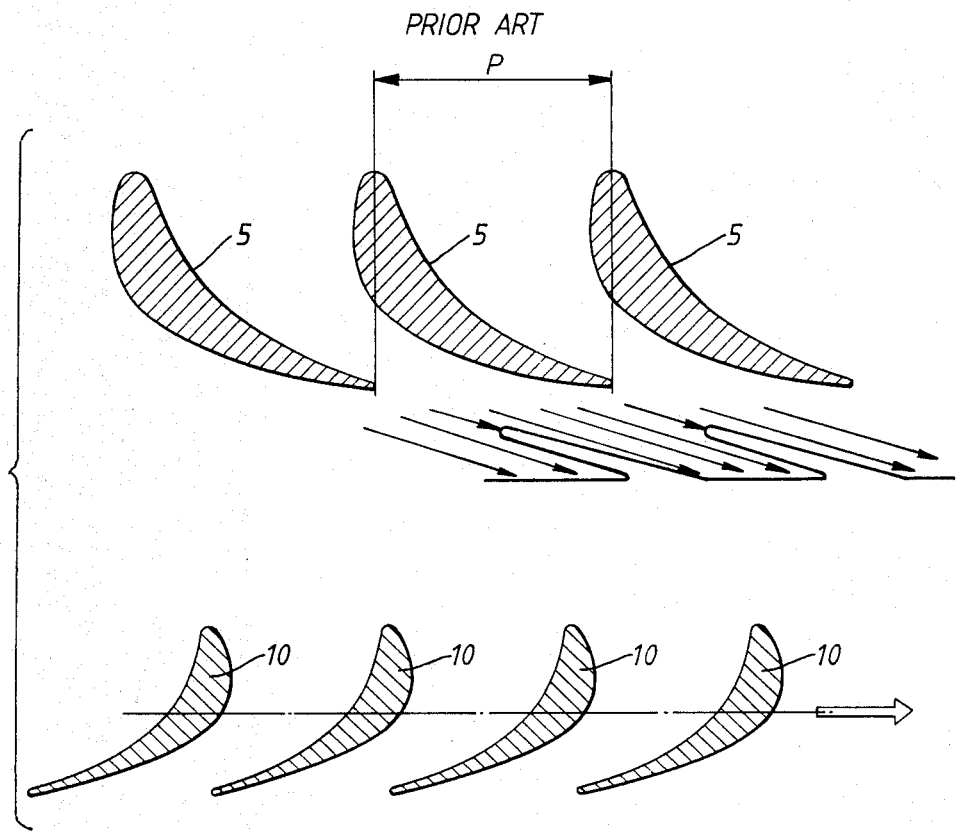
FIG. 11 is a view showing the velocity distribution of the wakeflow behind the nozzle plates.

FIG. 8 shows a fifth embodiment of a turbine according to the present invention. Blades 3*a*, 3*b* and 3*c* of three adjacent stages are integrally coupled by anchoring portions 11. With the fifth embodiment the same effects as in the first embodiment can also be obtained. Thus, with the present invention, anchoring portions 11 can be used to provide a coupling between blades 3 of three or more stages.

As explained above, with the present invention, even if resonance occurs in the blades of one stage, the resonant vibration energy is absorbed as the vibration energy of another stage that is coupled to it through the anchoring portions. As a result, the vibration level can be considerably reduced. The present invention therefore makes it possible for the incidents of blade failure due to resonance resulting from poor accuracy in predicting resonant frequencies of the blades to be effectively prevented. Furthermore, according to the present invention, the restrictions imposed on the number of nozzle plates can be relaxed in comparison to the conventional turbine. The pitch of the nozzle plates can therefore be selected for optimum efficiency, enabling turbine efficiency to be increased.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A multistage turbine comprising:

(a) a rotor disk having a cylindrical outer surface in which a plurality of dovetail-shaped grooves are formed;

(b) a casing surrounding said rotor disk;

(c) a plurality of dovetail-shaped anchoring portions, each one of said plurality of dovetail-shaped anchoring portions being slidably received in a corresponding one of said plurality of dovetail-shaped grooves;

(d) a first turbine stage comprising a plurality of axially aligned, circumferentially equally spaced first turbine blades, at least one of said first turbine blades being mounted on each one of said plurality of dovetail-shaped anchoring portions and projecting radially outwardly from said rotor disk;

(e) a second turbine stage located downstream of said first turbine stage and comprising a plurality of axially aligned, circumferentially equally spaced second turbine blades, at least one of said second turbine blades being mounted on each one of said plurality of dovetail-shaped anchoring portions and projecting radially outwardly from said rotor disk;

(f) a plurality of axially aligned, circumferentially equally spaced first nozzle plates mounted on said casing and projecting inwardly therefrom, said first nozzle plates being located upstream of and closely adjacent to said first turbine stage;

(g) a plurality of axially aligned, circumferentially equally spaced second nozzle plates mounted on said casing and projecting radially inwardly therefrom, said second nozzle plates being located between said first and second turbine stages and closely adjacent to said second turbine stage;

(h) a first circumferentially extending shroud surrounding said first turbine stage and connecting the radially outer ends of at least some of said first turbine blades, said first circumferentially extending shroud being divided by gaps at intervals in the circumferential direction; and (i) a second circumferentially extending shroud surrounding said second turbine stage and connecting the radially outer ends of at least some of said second turbine blades, said second circumferentially extending shroud being divided by gaps at intervals in the circumferential direction and the gaps dividing portions of said second circumferentially extending shroud being offset in the circumferential direction from the gaps dividing portions of said first circumferentially extending shroud, whereby, in use, the vibration level of said first and second turbine blades due to the eddies-containing wakeflow coming from the trailing edges of said first and second nozzle plates is greatly reduced.

2. A multistage turbine as recited in claim 1 wherein said plurality of dovetail-shaped grooves extend circumferentially in the cylindrical outer surface of said rotor disk.

3. A multistage turbine as recited in claim 1 wherein said plurality of dovetail-shaped grooves extend axially in the cylindrical outer surface of said rotor disk.

4. A multistage turbine as recited in claim 1 wherein the number of turbine blades in said first and second turbine stages is equal.

5. A multistage turbine as recited in claim 1 wherein the ratio of the number of turbine blades in said first turbine stage to the number of turbine blades in said second turbine stage is an integer.

6. A multistage turbine as recited in claim 1 wherein:

(a) the number of first nozzle plates is equal to the number of second nozzle plates and (b) the position of said first nozzle plates is offset in the circumferential direction by half the pitch between said second nozzle plates.

7. A multistage turbine as recited in claim 1 wherein said second nozzle plates are located closely adjacent to both of said turbine stages.

* * * * *